US007156698B2

(12) United States Patent
Yamashita

(10) Patent No.: US 7,156,698 B2
(45) Date of Patent: Jan. 2, 2007

(54) WATERLIGHT CONNECTOR

(75) Inventor: Kazunori Yamashita, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 11/205,412

(22) Filed: Aug. 17, 2005

(65) Prior Publication Data

US 2006/0040553 A1 Feb. 23, 2006

(30) Foreign Application Priority Data

Aug. 18, 2004 (JP) ..... 2004-238526

(51) Int. Cl.
*H01R 13/40* (2006.01)

(52) U.S. Cl. ..... 439/587

(58) Field of Classification Search ..... 439/587, 439/589

See application file for complete search history.

(56) References Cited

U.S. PATENT DOCUMENTS 5,145,410 A * 9/1992 Maejima et al. ..... 439/587
5,803,759 A * 9/1998 Griffith et al. ..... 439/274
6,095,860 A * 8/2000 Gehrke et al. ..... 439/587
6,183,296 B1 2/2001 Pacini et al.
6,638,108 B1 * 10/2003 Tachi ..... 439/595
6,739,908 B1 * 5/2004 Hamai et al. ..... 439/587
6,872,092 B1 * 3/2005 Oka ..... 439/587
2002/0177359 A1 * 11/2002 Fukatsu et al. ..... 439/587
2003/0087551 A1 * 5/2003 Okayasu et al. ..... 439/587

* cited by examiner

*Primary Examiner*—Neil Abrams
*Assistant Examiner*—Harshad C Patel
(74) *Attorney, Agent, or Firm*—Gerald E. Hespos; Anthony J. Casella

(57) ABSTRACT

Resilient deformation of a rubber plug (13) can be absorbed by a housing-side groove (28A) and a holder-side groove (28B) formed to surround all wire insertion holes (24), thereby preventing the displacements of the wire insertion holes (24). Thus, a reduction in operability at the time of inserting female terminal fittings (12) and wires (20) through the rubber plug (13) can be avoided. Further, a housing-side pressing portion (22A) and a holder-side pressing portion (22B) are pressed into the housing-side groove (28A) and the holder-side groove (28B) over the entire periphery to press the rubber plug (13) into contact with the inner surface of an accommodation recess (21), sealability between a housing (11) and the rubber plug (13) can be ensured.

6 Claims, 6 Drawing Sheets

WATERLIGHT CONNECTOR

BACKGROUND OF THE INVENTION

1. Field of the Invention

The invention relates to a watertight connector with a resilient plug.

2. Description of the Related Art

U.S. Pat. No. 6,183,296 discloses a watertight connector with a one piece rubber plug. This connector has a housing with a plurality of cavities and an accommodation recess is formed in the rear end surface of the housing. A one-piece rubber plug is accommodated in the accommodation recess of the housing and has wire insertion holes at positions corresponding to the cavities. The rubber plug is pressed by a rubber-plug holder formed with window holes at positions corresponding to the cavities. Wires connected with terminal fittings are inserted through the wire insertion holes of the rubber plug. As a result, sealing is achieved between the outer peripheral surface of the rubber plug and the inner peripheral surface of the accommodation recess and between the inner peripheral surfaces of the wire insertion holes and the outer surface of the wires.

The rubber plug of the above-described watertight connector is deformed resiliently inward within the plane of the plug as the plug is being accommodated into the accommodation recess. As a result, a plurality of wire insertion holes in the rubber plug may be displaced from the cavities or the window holes. A plurality of wire insertion holes often are arranged side by side. In this situation, the wire insertion holes at the outermost positions are displaced most. The wire insertion holes that are displaced most can interfere sufficiently with the terminal fittings and the wires to impair insertion efficiency.

Thought has been given to forming grooves in the front and rear surfaces of the rubber plug between the outer periphery of the rubber plug and the outermost wire insertion holes. The grooves conceivably could absorb the deformation of the rubber plug and prevent the displacement of the wire insertion holes. However, the grooves would reduce the resilient force between the inner peripheral surface of the accommodation recess and the outer peripheral surface of the rubber plug. Therefore, the grooves could adversely affect sealing between the housing and the plug.

The invention was developed in view of the above problem, and an object thereof is to avoid reducing insertion efficiency when inserting terminal fittings and wires through a resilient plug and to ensure sealing between the housing and the resilient plug.

SUMMARY OF THE INVENTION

The invention relates to a watertight connector with a housing formed with cavities for receiving terminal fittings that have been secured to ends of wires. An accommodation recess is formed at an arranging surface of the housing, and a resilient plug is accommodated in the accommodation recess. The resilient plug has wire insertion holes that substantially align with the respective cavities. A plug holder is assembled with the resilient plug and/or the housing to hold the resilient plug, and is formed with window holes. The inner peripheral surface of the accommodation recess achieves pressing contact against the outer peripheral surface of the resilient plug and deforms the resilient plug inward within the plane of the resilient plug. As a result, the resilient plug in the accommodation recess exerts a resilient force against the housing and achieves sealing between the housing and the resilient plug. At least one groove is formed radially between the outer peripheral surface of the resilient plug and the outermost wire insertion hole in at least a surface of the resilient plug to face the resilient-plug holder and/or the housing. A pressing member is provided on at least a surface of the plug holder and/or the housing and is configured to be pressed into the groove when the plug holder is assembled with the resilient plug and/or the housing. The pressing member presses the resilient plug into contact with the inner circumferential surface of the accommodation recess to achieve good sealing.

The groove between the outer peripheral surface of the resilient plug and the outermost wire insertion hole absorbs the resilient deformation of the resilient plug and substantially prevents the wire insertion holes from the window holes of the plug holder. Thus, the terminal fittings and the respective wires can be inserted efficiently through the resilient plug.

The window holes preferably are provided substantially in conformity with the respective cavities.

The at least one groove preferably comprises two grooves formed inward from the opposite ends of the resilient plug with respect to an arranging direction of the wire insertion holes.

Grooves preferably are formed in both a surface of the resilient plug to face the back surface of the accommodation recess and the surface of the resilient plug to substantially face the plug holder. Further, pressing members preferably are provided on both the back surface of the accommodation recess and the resilient-plug holder. The pressing member on the back surface of the accommodation recess is pressed at least partly into the grooves when the resilient plug is accommodated into the accommodation recess. Thus, a deformation absorbing area of the rubber plug along the longitudinal direction of the wire insertion holes extends both to sides of the wire insertion holes towards the plug holder and to sides of the wire insertion holes towards the bottom surface of the accommodation recess. Therefore, the terminal fittings and the wires can be inserted more easily through the rubber plug.

The housing-side grooves and holder-side grooves preferably are formed at substantially symmetrical positions on the respective surfaces of the resilient plug.

The housing-side grooves and holder-side grooves preferably are displaced to at least partly overlap along the arranging direction.

The pressing members preferably are tapered or converging towards their leading ends. Thus, the pressing members can be pressed smoothly into the grooves even if the entrances of the grooves become narrower as the resilient plug is urged into the accommodation recess.

The grooves preferably are formed to substantially surround all of the wire insertion holes. Additionally, the pressing members preferably can be pressed into the respective grooves over substantially entire periphery.

The grooves preferably surround all the wire insertion holes and absorb the resilient deformation of the resilient or rubber plug that would otherwise act on the wire insertion holes. Thus, the wire insertion holes will not be narrowed by the resilient deformation. As a result, the terminal fittings can be inserted efficiently.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
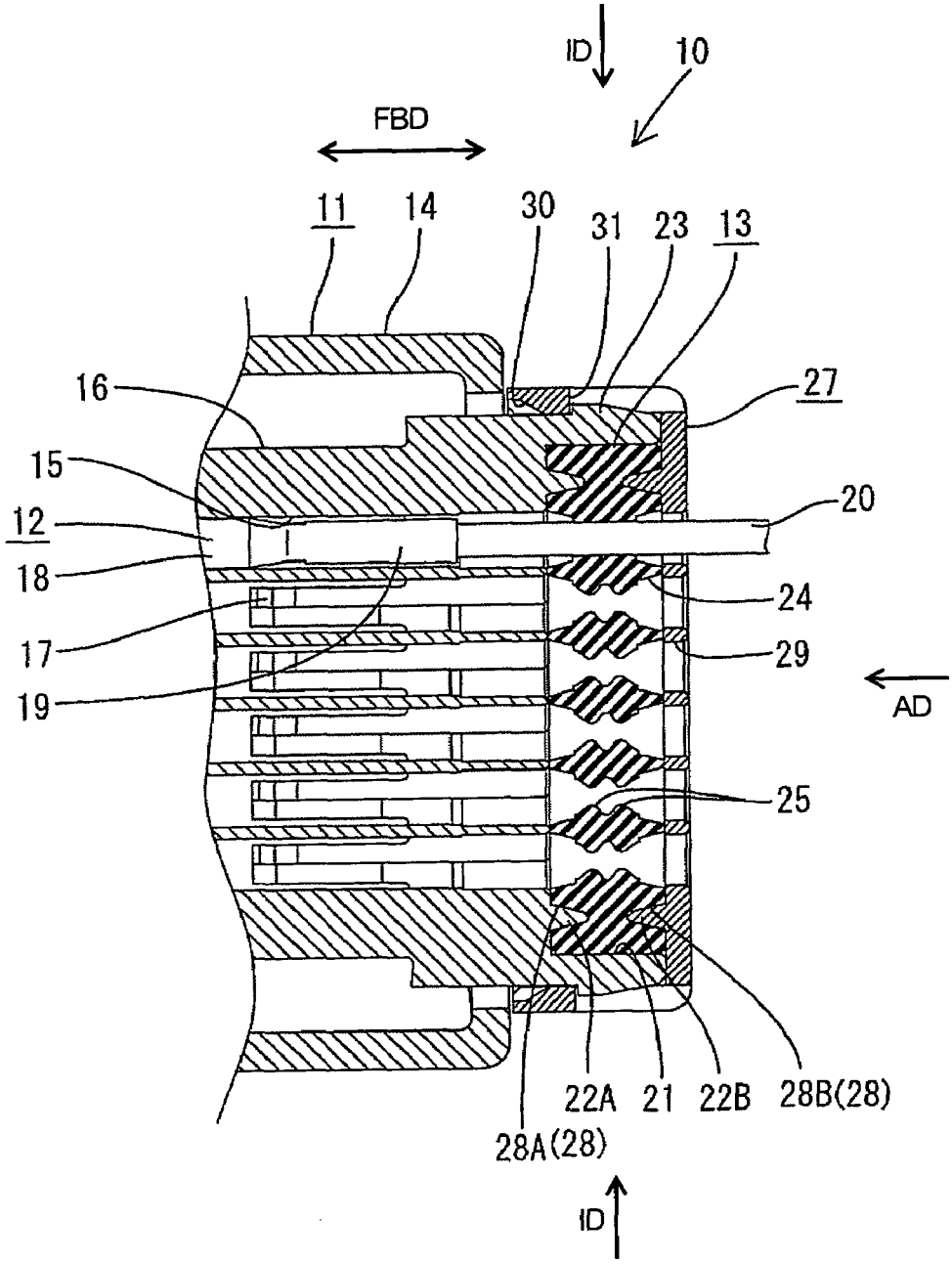
FIG. 1 is a plan view in section showing a used state of a watertight connector according to one embodiment of the invention.

A watertight connector according to the invention is identified by the numeral 10 in FIG. 1. The watertight connector includes a housing 11, terminal fittings 12 and a resilient or rubber plug 13. The left end of the watertight connector 10 in FIG. 1 is connectable with an unillustrated mating connector and is referred to herein as the front.

Figure 2:
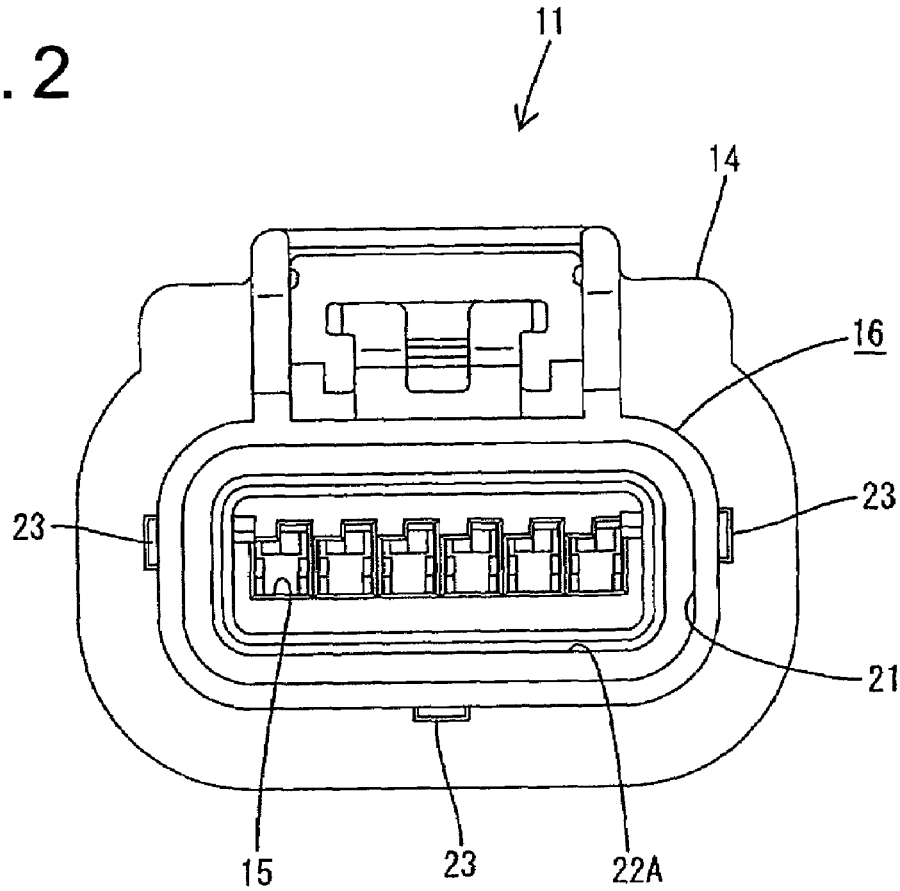
FIG. 2 is a rear view of a connector housing.
Figure 7:
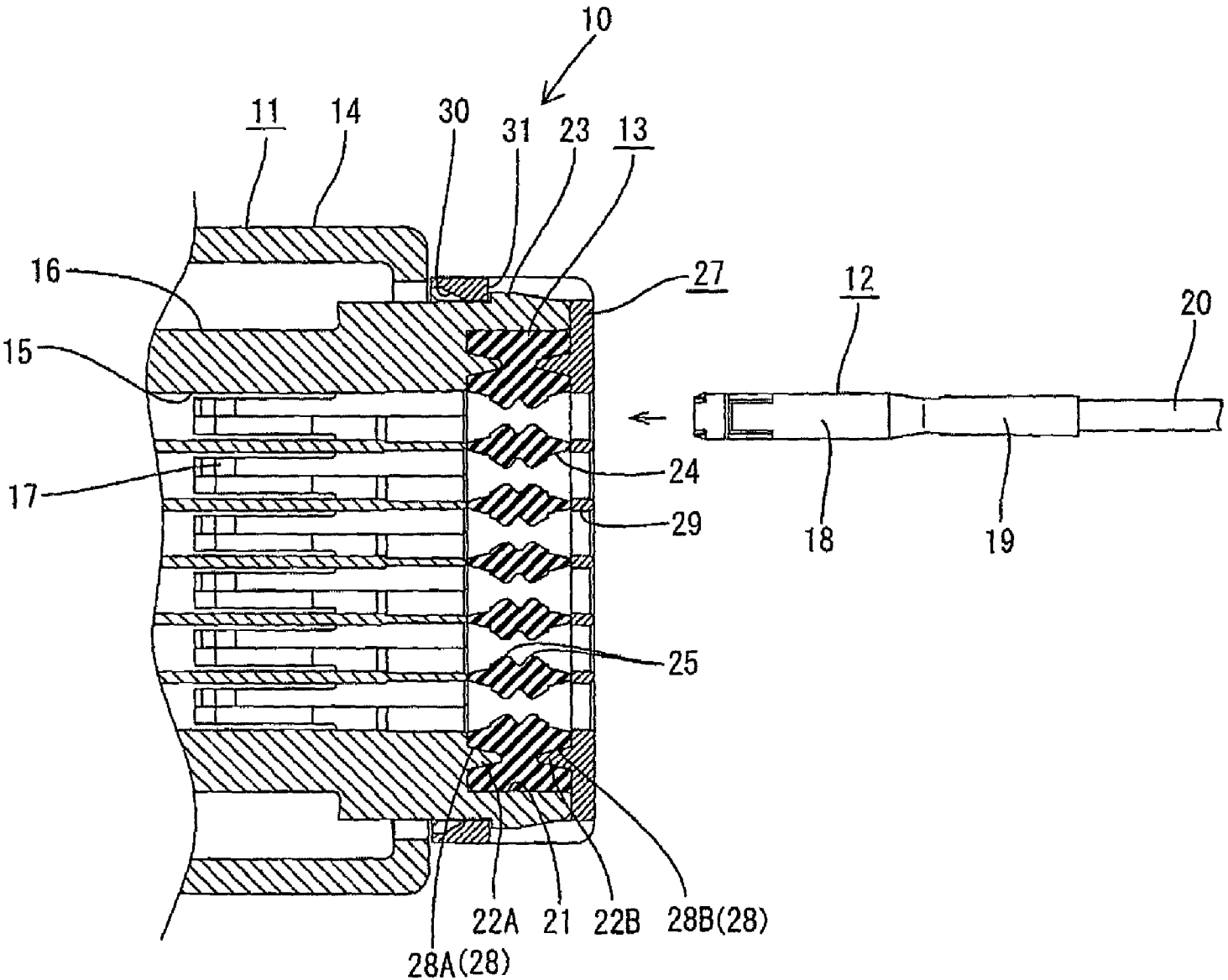
FIG. 7 is a plan view in section showing a state where a female terminal fitting is inserted into the watertight connector.

The housing 11 is made e.g. of a synthetic resin and is formed to define a block shape, as shown in FIGS. 1 and 2. The housing 11 has an outer tube 14 and an inner tube 16 disposed within the outer tube 14. Cavities 15 extend in forward and backward directions FBD through the inner tube 16 and are arranged substantially side by side along width direction WD, which is substantially normal to the forward and backward directions FBD. A lock 17 is provided in each cavity 15 for retaining the female terminal fittings 12 in the respective cavities 15. As shown in FIG. 7, each female terminal fitting 12 is formed by bending or press-working an electrically conductive metal plate. A substantially box-shaped connecting portion 18 is formed at the front of the female terminal fitting 12 and has a resilient contact (not shown) inside. A wire barrel 19 is formed at the rear of the female terminal fitting 12 and is crimped, bent or folded into connection with an end of a wire 20.

A clearance is defined between the inner tube 16 and the outer tube 14 for receiving the housing of the unillustrated mating connector. A rearwardly open accommodation recess 21 is formed in the rear end of the inner tube 16 and is configured for accommodating the rubber plug 13. The accommodation recess 21 extends transversely beyond the surface AS that defines the rear entrance to the cavities 15. Thus, the rubber plug 13 can be arranged in the accommodation recess 21 in an arrangement direction AD. A substantially tubular housing-side pressing portion 22A projects back from the rearwardly facing wall of the accommodation recess 21 and surrounds all the cavities 15. The housing-side pressing portion 22A tapers towards the projecting end. As shown in FIG. 2, lock projections 23 are provided at the rear end of the outer peripheral surface of the housing 11.

Figure 6:
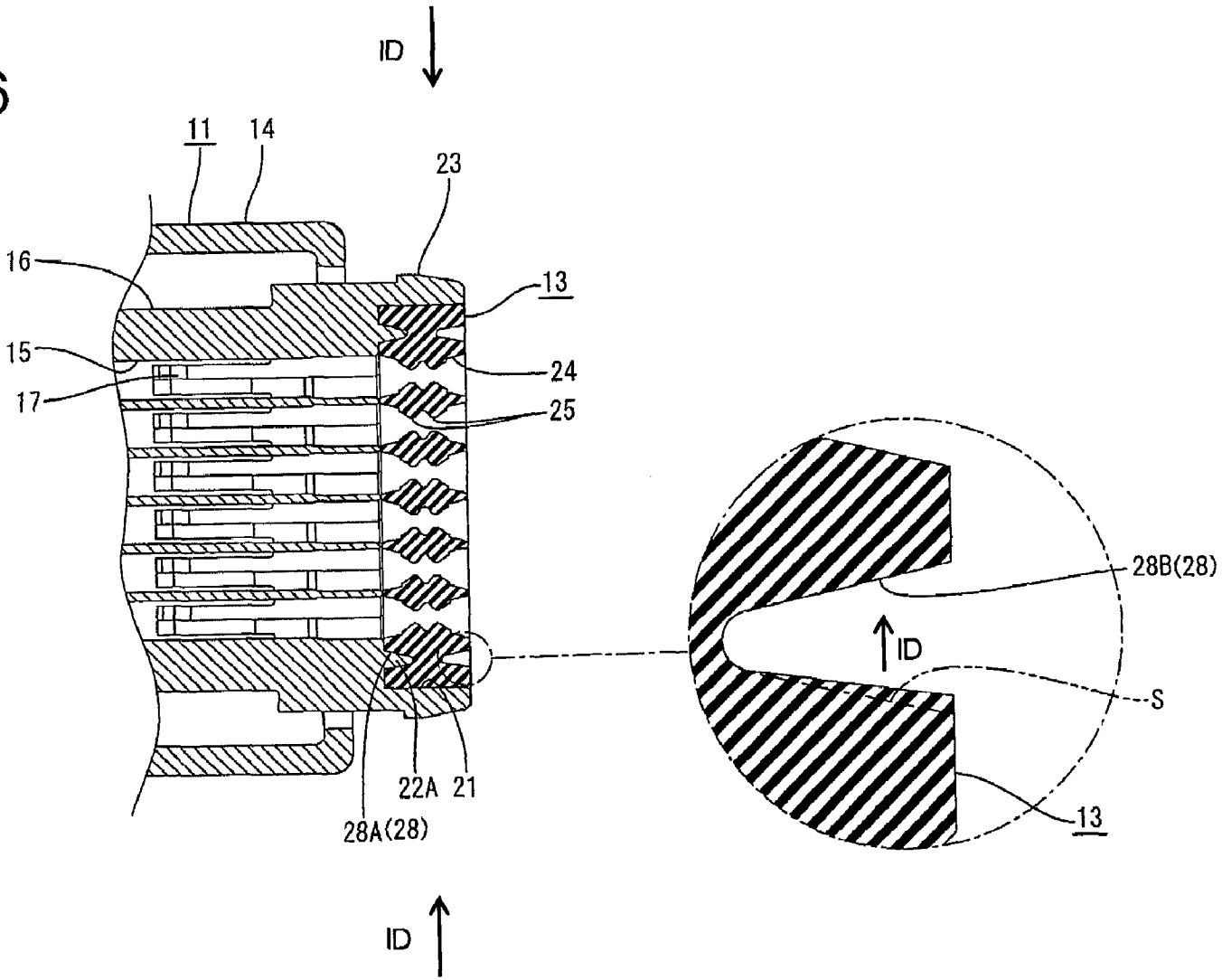
FIG. 6 is a plan view in section showing a state where the rubber plug is assembled with the connector housing.

As shown in FIG. 6, the rubber plug 13 is accommodated in the accommodation recess 21. Further, as shown in FIG. 3, the rubber plug 13 is a wide thick plate that covers the rear surfaces of all the cavities 15.

Figure 5:
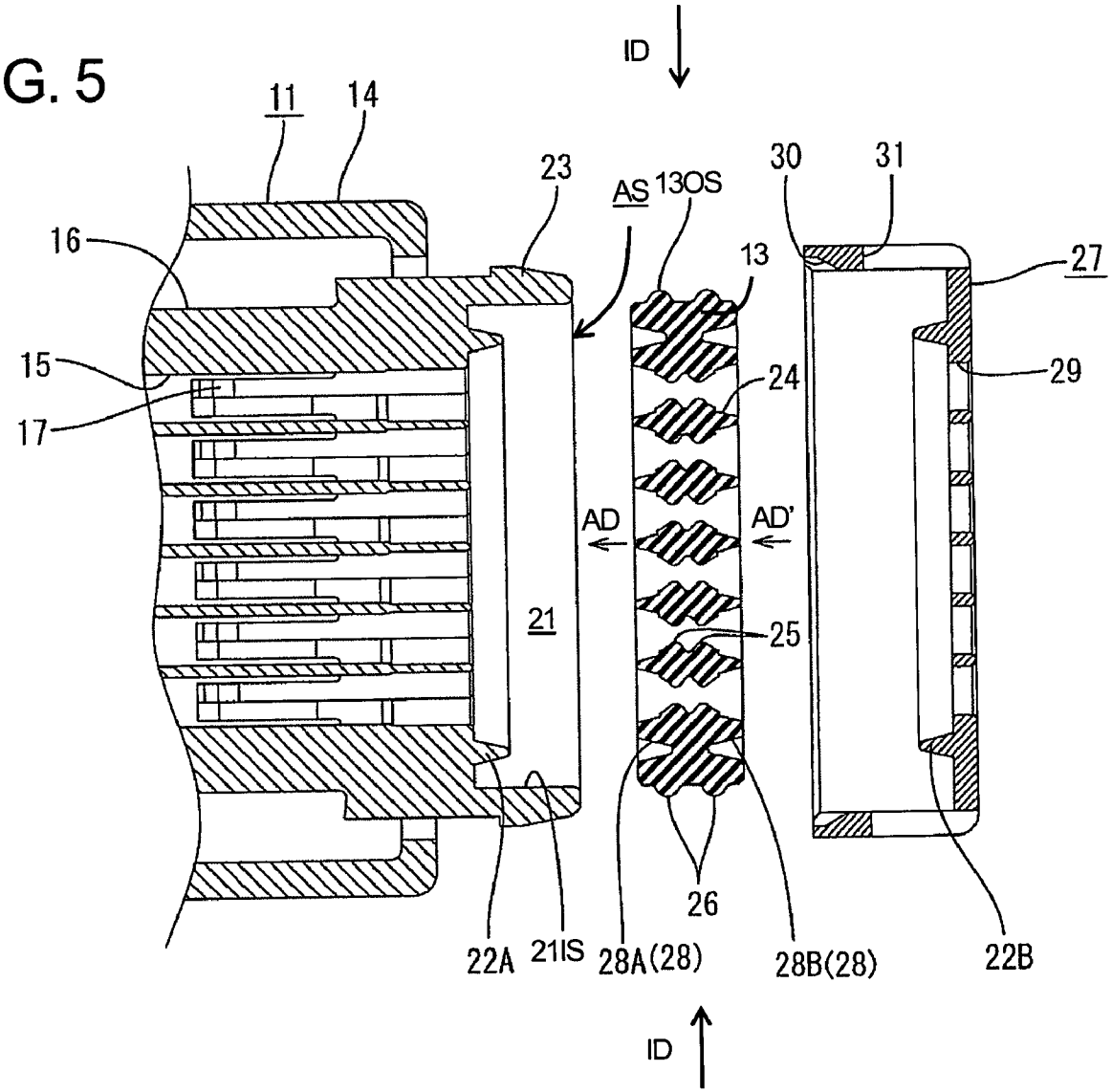
FIG. 5 is a plan view in section showing a state before the connector housing, the rubber plug and the rubber-plug holder are assembled.

As shown in FIG. 5, wire insertion holes 24 penetrate the rubber plug 13 at positions substantially corresponding to the respective cavities 15 of the housing 11. Inwardly directed lips 25 are formed circumferentially on the inner surface of each wire insertion hole 24 for close resilient contact with the outer circumferential surface of the wire 20. Outwardly directed lips 26 are arranged one after the other along the forward and backward directions FBD on the outer surface 13OS of the rubber plug 13. The lips 26 on the outer surface 21OS of the rubber plug 13 press into contact with the inner surface 21IS of the accommodation recess 21 when the rubber plug 13 is accommodated into the accommodation recess 21. As a result, the lips 26 and the rubber plug 13 are deformed resiliently in inward directions ID of the plane of the rubber plug 13 and the inner surface 21IS of the accommodation recess 21 and the lips 26 closely contact each other due to the resulting resilient forces.

Figure 3:
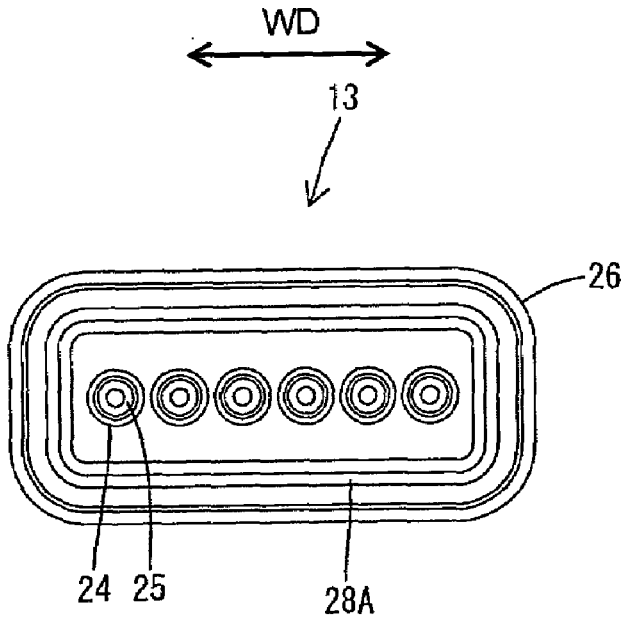
FIG. 3 is a front view of a rubber plug.

As shown in FIGS. 3 and 6, grooves 28 are formed in the opposite major surfaces of the rubber plug 13 and surround all of the wire insertion holes 24. The grooves 28 become narrower at more inward positions in the rubber plug 13. Thus, each groove 28 has a substantially converging triangular or trapezoid shape in cross-section (see e.g. enlarged portion of FIG. 6). The forwardly-facing groove 28 is referred to herein as the housing-side groove 28A, while the rearwardly-facing groove 28 is referred to herein as the holder-side groove 28B. The housing-side and holder-side grooves 28A, 28B are at substantially symmetrical positions of the front and rear surfaces of the rubber plug 13.

Figure 4:
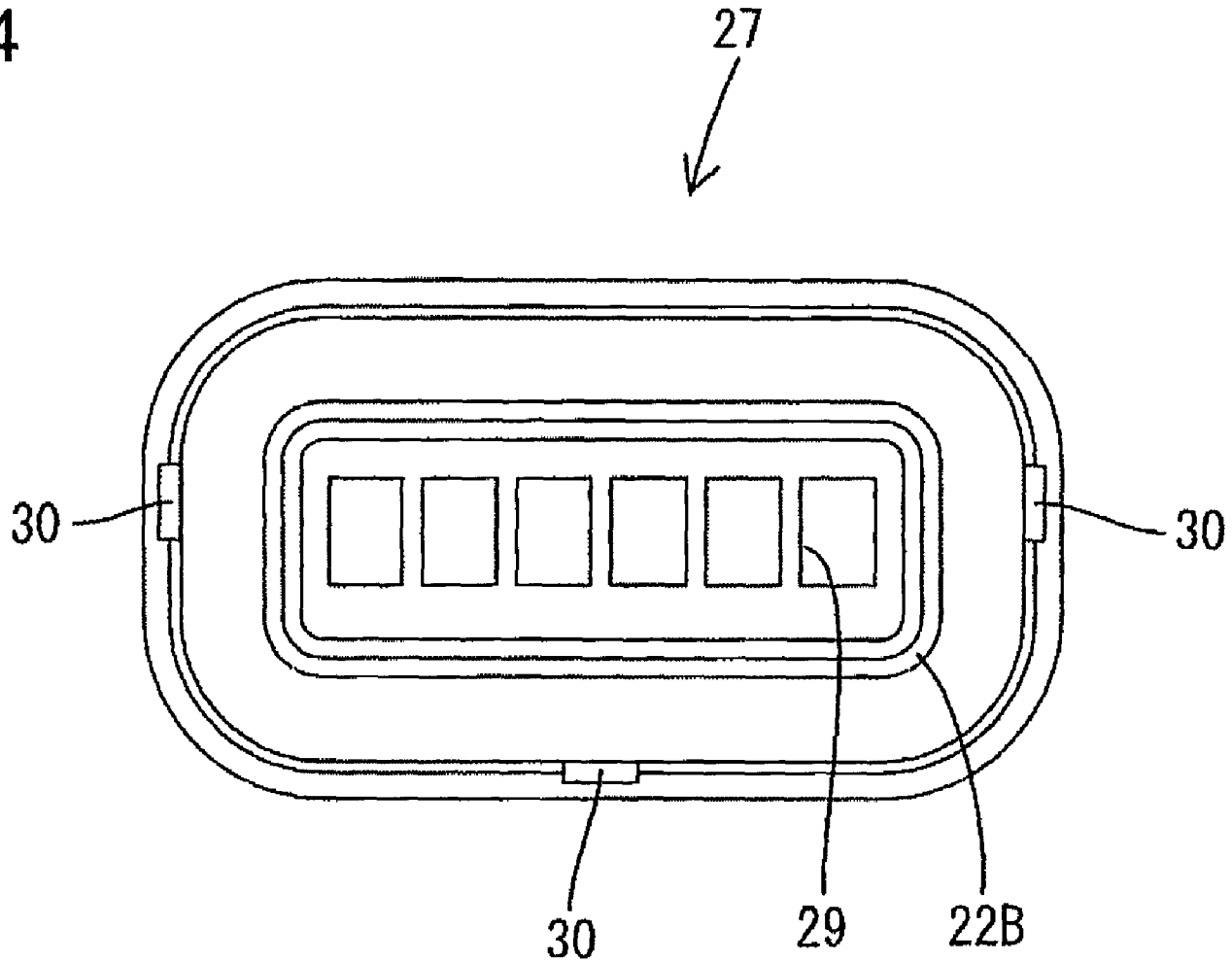
FIG. 4 is a front view of a rubber-plug holder.

As shown in FIG. 1, a plug holder 27 is mountable behind the rubber plug 13. The plug holder 27 is made e.g. of a synthetic resin substantially into a cap shape and has a substantially open front end as shown in FIGS. 1 and 4. Substantially rectangular window holes 29 are so formed in the rear wall of the plug holder 27 at positions substantially corresponding to the respective cavities 15 and the respective wire insertion holes 24. Further, slanted or rounded guiding surfaces 30 for guiding the lock projections 23 are formed at positions on the front end of the surrounding wall of the plug holder 27 substantially corresponding to the lock projections 23 of the housing 11. Engaging portions 31 are formed behind the slanted surfaces 30 and are engageable with the lock projections 23. Further, a tubular holder-side pressing portion 22B projects forward from the surface of the rear wall of the plug holder 27 to face the rubber plug 13. The holder-side pressing portion 22B surrounds all of the window holes 29 at positions corresponding to the holder-side groove 28B and is tapered.

The holder-side pressing portion 22B is slightly larger than the holder-side groove 28B. Similarly, the housing-side pressing portion 22A is slightly larger than the housing-side groove 28A.

The watertight connector 10 is assembled by inserting the rubber plug 13 into the accommodation recess 21 of the housing 11 from behind and in the accommodation direction AD, as shown by an arrow in FIG. 5. The rubber plug 13 and the front sides of the lips 26 on the outer peripheral surface 13OS of the rubber plug 13 are pressed into contact with the inner peripheral surface 21IS of the accommodation recess 21 as the rubber plug 13 is inserted into the accommodation recess 21. As a result, the rubber plug 13 starts resiliently deforming in inward directions ID in the plane of the rubber plug 13.

The inner wall of the housing-side groove 28A then is deformed resiliently in inward directions ID in the plane of the rubber plug 13. Thus, the entrance of the housing-side groove 28A is narrowed in inward directions ID in the plane of the rubber plug 13 and in directions substantially normal to the arranging direction AD. Thus, resilient deformations between the housing-side groove 28A and the ends of the rubber plug 13 are absorbed, so that the resilient deformation of the rubber plug 13 does not influence the front parts of the wire insertion holes 24, and particularly the wire insertion holes at the outermost positions. As a result, the displacement of the front parts of the wire insertion holes 24 at the outermost positions is prevented. It should be noted that there is almost no influence on the displacement on the wire insertion holes 24 at inner positions. Further, the housing-side groove 28A surrounds all of the wire insertion holes 24. Therefore, the housing-side groove 28A absorbs displacement along the arranging direction WIH-AD of the wire insertion holes 24 and along a direction intersecting the arranging direction WIH-AD of the wire insertion holes 24 to ensure no influence on the wire insertion holes 24. Accordingly, the front parts of the wire insertion holes 24 will not narrow or otherwise deform along directions intersecting with the arranging direction WIH-AD of the wire insertion holes 24.

The leading end of the housing-side pressing portion 22A starts touching the inner wall of the housing-side groove 28A from the front when more than half (e.g. substantially two thirds) of the rubber plug 13 has entered the accommodation recess 21. At this time, the entrance of the housing-side groove 28A is deformed and narrowed along inward directions ID in the plane of the rubber plug 13, as described above. However, the housing-side pressing portion 22A is tapered. Thus, the leading end of the housing-side pressing portion 22A enters smoothly into the housing-side groove 28A.

The housing-side pressing portion 22A is pressed into the housing-side groove 28A over the entire periphery as the rubber plug 13 is pressed farther into the accommodation recess 21 along the arranging direction AD. As a result, the housing-side pressing portion 22A pushes the inner peripheral wall of the housing-side groove 28A back towards the inner peripheral surface 21IS of the accommodation recess 21 and in directions substantially opposite the inward directions ID. In this way, the housing-side pressing portion 22A causes a resilient force to act at the front side of the sealing surface between the housing 11 and the rubber plug 13. Accordingly, the front lip 26 of the rubber plug 13 and the inner peripheral surface of the front side of the accommodation recess 21 are brought firmly into close contact with each other.

At this time, the rear lip 26 on the outer peripheral surface 13OS of the rubber plug 13 is pressed into contact with the inner peripheral surface 21IS of the accommodation recess 21, and the rubber plug 13 starts resiliently deforming in inward directions ID in the plane of the rubber plug 13. Then, as shown in FIG. 6, the peripheral wall of the holder-side groove 28B at the side closer to the accommodation recess 21 deforms resiliently in inward directions ID in the plane of the rubber plug 13, as shown in FIG. 6. Accordingly, the entrance of the holder-side groove 28B is narrowed in inward directions of the plane of the rubber plug 13. In this regard the broken line S in the rubber plug 13 in the enlarged portion of FIG. 6 shows the inner peripheral surface of the holder-side groove 28B before the resilient deformation. Displacements of the rear parts of the wire insertion holes 24 at the outermost positions are prevented for the same reason as in the case of the housing-side groove 28A and housing-side pressing portion 22A. Further, the rear parts of the wire insertion holes 24 will not narrow in directions intersecting the arranging direction WIH-AD of the wire insertion holes 24.

The front parts of the wire insertion holes 24 are not displaced when the rubber plug 13 is at the proper mount position with the front surface of the rubber plug 13 abutting the rearwardly facing surface of the accommodation recess 21 in the arranging direction AD. Thus, the openings of the front parts of the wire insertion holes 24 and the cavities 15 are substantially coaxial.

The plug holder 27 is mounted after the rubber plug 13 is at the proper position in the accommodation recess 21. More particularly, the plug holder 27 is mounted from behind and in an arranging direction AD' that is substantially parallel to the arranging direction AD of the resilient plug 13, as shown by an arrow of FIG. 5. The slanted surfaces 30 then contact the lock projections 23 from behind and in the arranging direction AD'. The plug holder 27 then is pushed farther forward in the arranging direction AD', and the lock projections 23 move over the slanted surfaces 30 to engage the engaging portions 31 on the side walls of the plug holder 27 for locking the plug holder 27 to the housing 11.

The holder-side pressing portion 22B is pressed into the holder-side groove 28B in the process of assembling the rubber-plug holder 27 with the housing 11. First, the leading end of the holder-side pressing portion 22B starts touching the inner peripheral wall of the holder-side groove 28B from behind and in the arranging direction AD' when the plug holder 27 is assembled with the housing 11.

As described above, the entrance of the holder-side groove 28B is deformed to narrow in inward directions ID in the plane of the rubber plug 13 (see FIG. 6). However, the leading end of the holder-side pressing portion 22B is tapered and can be inserted smoothly into the holder-side groove 28B.

The rear parts of the wire insertion holes 24 are not displaced significantly when the rubber-plug holder 27 is at the proper position on the housing 11. Thus, the openings of the rear parts of the wire insertion holes 24 and the window holes 29 are substantially coaxial.

The holder-side pressing portion 22B is pressed into the holder-side groove 28B over substantially the entire periphery, thereby pushing the resiliently deformed portion of the rubber plug 13 outward of the holder-side groove 28B back towards the inner peripheral surface 21IS of the accommodation recess 21. Thus, a resilient force acts at the rear side of the sealing surface between the housing 11 and the rubber plug 13. The rear lip 26 of the rubber plug 13 and the inner peripheral surface 21IS of the rear side of the accommodation recess 21 are brought firmly into close contact with each other. As described above, good sealing is ensured between the housing 11 and the rubber plug 13 since the lips 26 at the front and rear sides of the rubber plug 13 are brought firmly into contact with the inner peripheral surface 21IS of the accommodation recess 21.

Each female terminal fitting 12 secured to the end of a wire 20 is inserted through a window hole 29 of the plug holder 27 and then through a wire insertion hole 24 after the plug holder 27 is assembled with the housing 11, as shown by an arrow of FIG. 7. The female terminal fitting 12 widens the wire insertion hole 24 and passes into the cavity 15. The female terminal fitting 12 is retained by the lock 17 after sufficient insertion into the cavity 15, and the inner lips 25 of the wire insertion hole 24 are restored resiliently to closely contact the outer circumferential surface of the wire 20 and/or the terminal fitting 12. Thus hermetic sealing is achieved between the wire insertion hole 24 and the wire 20 and/or the terminal fitting 12.

The window holes 29, the wire insertion holes 24 and the cavities 15 are substantially coaxial. Thus, operations of inserting the female terminal fittings 12 and the wires 20 through the corresponding window holes 29, pushing them through the wire insertion holes 24 and accommodating the female terminal fittings 12 in the cavities 15 can be performed more easily. Accordingly, the female terminal fittings 12 and the wires 20 can be inserted through the rubber plug 13 more efficiently.

The front and rear parts of the wire insertion holes 24 will not be narrowed by deformation of the rubber plug 13 in directions intersecting the arranging direction WIH-AD of the wire insertion holes 24, as described above. Thus, the female terminal fittings 12 and the wires 20 can be inserted through the rubber plug 13 more efficiently.

As described above, the housing-side groove 28A and the holder-side groove 28B are formed between the outermost wire insertion holes 24 and the opposite ends of the rubber plug 13 with respect to the arranging direction WIH-AD of the wire insertion holes 24. Thus, the resilient deformation of the rubber plug 13 is absorbed and the wire insertion holes 24 will not displace. Therefore, the female terminal fittings 12 and the wires 20 can be inserted through the rubber plug 13 more efficiently.

Resilient deformation of the rubber plug 13 is absorbed by the housing-side groove 28A and the holder-side groove 28B that surround all of the wire insertion holes 24. Thus, narrowing deformations of the wire insertion holes 24 is prevented substantially. Therefore, the female terminal fittings 12 and the wires 20 can be inserted through the rubber plug 13 more efficiently.

The housing-side pressing portion 22A and the holder-side pressing portion 22B are pressed respectively into the housing-side groove 28A and the holder-side groove 28B to press the rubber plug 13 into contact with the inner peripheral surface 21IS of the accommodation recess 21. Thus, good sealing between the housing 11 and the rubber plug 13 is ensured.

The invention is not limited to the above described and illustrated embodiment. For example, the following embodiments are also embraced by the technical scope of the present invention as defined by the claims. Beside the following embodiments, various changes can be made without departing from the scope and spirit of the present invention as defined by the claims.

The grooves 28 are formed in both surfaces of the rubber plug 13 in the foregoing embodiment. However, the housing-side groove 28A in the front surface of the rubber plug 13 can be omitted.

The housing 11 and the plug holder 27 are formed respectively formed with the housing-side pressing portion 22A and the holder-side pressing portion 22B in the foregoing embodiment. However, a pressing member separate from the housing 11 and/or the plug holder 27 may be provided on the housing 11 and/or the plug holder 27.

The housing-side groove 28A and the holder-side groove 28B are at substantially symmetrical positions in the rear and front surfaces of the rubber plug 13 in the foregoing embodiment. However, the housing-side groove 28A and the holder-side groove 28B may be displaced along the arranging direction WIH-AD of the wire insertion holes 24 and may overlap in a depth direction along the arranging direction AD. Thus, the influence of the resilient deformation of the rubber plug 13 can be better eliminated.

The housing-side pressing portion 22A and the holder-side pressing portion 22B are tapered in the foregoing embodiment. However, the housing-side groove 28A or the holder-side groove 28B can have other shapes, provided that they can press the inner circumferential wall of the housing-side groove 28A or the holder-side groove 28B.

The housing-side groove 28A or the holder-side groove 28B are between the outermost wire insertion holes 24 and the opposite ends of the rubber plug 13. Other part of the housing-side groove 28A or the holder-side groove 28B may be omitted.

The invention is applied to a female connector with the female terminal fittings 12 in the foregoing embodiment, but it may be applied to male connectors with male terminal fittings.

The number of window holes 29 in the plug holder 27 need not equal the number of wire insertion holes 24 in the rubber plug 13. For example, one window hole 29 may be provided for two or more wire insertion holes 24.

What is claimed is:

1. A watertight connector, comprising:

a housing with opposite front and rear ends, an accommodation recess formed in the rear end of the housing, the accommodation recess having a rearwardly facing base and a peripheral wall extending rearwardly from the base, cavities extending forward from the base of the accommodation recess for receiving terminal fittings secured to ends of wires;

a resilient plug in the accommodation recess, the resilient plug having a front surface facing the base of the accommodation recess, and a rear surface facing rearwardly from the housing, an outer peripheral surface extending between the front and rear surfaces, wire insertion holes extending through the resilient plug from the front surface to the rear surface and substantially aligned with the cavities, a holder-side groove in the rear surface of the resilient plug between the outer peripheral surface and the wire insertion holes so that the holder-side groove substantially surrounds all of the wire insertion holes, the holder-side groove being tapered gradually to narrower dimensions at locations farther from the rear surface; and a plug holder assembled with the rear end of housing to hold the resilient plug in the accommodation recess, window holes formed through the plug holder and aligned respectively with the wire insertion holes of the resilient plug, and a pressing member formed on the plug holder and having a tapered shape substantially corresponding to a tapered shape defined by the holder-side groove in the resilient plug, the pressing member being engaged in the holder-side groove of the resilient plug for urging the outer peripheral surface of the resilient plug into sealed engagement with the peripheral wall of the accommodation recess.

2. The watertight connector of claim 1, wherein a housing-side groove is formed in the front surface of the resilient plug between the outer peripheral surface and the wire insertion holes, and wherein the base of the accommodation recess has a pressing member engaged in the housing-side groove for urging the outer peripheral surface of the resilient plug into sealed engagement with the peripheral wall of the accommodation recess.

3. The watertight connector of claim 1, wherein said pressing member is tapered towards its leading end.

4. The watertight connector of claim 1, wherein the pressing member is configured to be pressed into the groove over an entire periphery of the groove.

5. The watertight connector of claim 1, wherein the groove is tapered to define a substantially V-shaped cross section.

6. The watertight connector of claim 1, wherein the holder-side groove extends less than halfway from the rear surface towards the front surface of the resilient plug.

* * * * *

UNITED STATES PATENT AND TRADEMARK OFFICE

CERTIFICATE OF CORRECTION

PATENT NO. : 7,156,698 B2
APPLICATION NO. : 11/205412
DATED : January 2, 2007
INVENTOR(S) : Kazunori Yamashita It is certified that error appears in the above-identified patent and that said Letters Patent is hereby corrected as shown below:

On the title page, item [54] title should read
(54) WATERTIGHT CONNECTOR

Signed and Sealed this

Sixth Day of March, 2007

JON W. DUDAS
*Director of the United States Patent and Trademark Office*